US012807437B2

(12) United States Patent
Kasai et al.

(10) Patent No.: US 12,807,437 B2
(45) Date of Patent: Nov. 24, 2026

(54) MEDIUM FEEDER AND IMAGE FORMING SYSTEM

(71) Applicants: Tadashi Kasai, Kanagawa (JP); Tatsuya Sugawara, Kanagawa (JP)

(72) Inventors: Tadashi Kasai, Kanagawa (JP); Tatsuya Sugawara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 19/171,372

(22) Filed: Apr. 7, 2025

(65) Prior Publication Data

US 2025/0315000 A1 Oct. 9, 2025

(30) Foreign Application Priority Data

Apr. 8, 2024 (JP) ..... 2024-062268

(51) Int. Cl.
*B65H 3/48* (2006.01)
*B65H 3/12* (2006.01)

(52) U.S. Cl.
CPC ..... *B65H 3/48* (2013.01); *B65H 3/128* (2013.01); *B65H 2406/1222* (2013.01); *B65H 2406/13* (2013.01)

(58) Field of Classification Search
CPC ..... B65H 3/128; B65H 3/48; B65H 2406/1132; B65H 2406/11325; B65H 2406/122; B65H 2406/1222; B65H 2406/13; B65H 2511/13; B65H 2515/10; B65H 2551/20; B65H 2551/21
See application file for complete search history.

(56) References Cited

U.S. PATENT DOCUMENTS

| | | | | |
|---|---|---|---|---|
| 2013/0087967 | A1* | 4/2013 | Fuda | B65H 3/48 271/97 |
| 2014/0339759 | A1 | 11/2014 | Takahashi et al. | |
| 2014/0346728 | A1 | 11/2014 | Fuda et al. | |
| 2015/0166280 | A1 | 6/2015 | Hino et al. | |
| 2016/0016740 | A1 | 1/2016 | Niikura et al. | |
| 2016/0107853 | A1 | 4/2016 | Hashimoto et al. | |
| 2016/0107854 | A1 | 4/2016 | Hashimoto et al. | |
| 2016/0122144 | A1 | 5/2016 | Fukumoto et al. | |
| 2016/0264370 | A1 | 9/2016 | Okutsu et al. | |
| 2017/0081140 | A1 | 3/2017 | Fukumoto et al. | |
| 2017/0160689 | A1 | 6/2017 | Sugawara et al. | |
| 2017/0327329 | A1 | 11/2017 | Takahashi et al. | |
| 2018/0237239 | A1 | 8/2018 | Okutsu et al. | |

(Continued)

FOREIGN PATENT DOCUMENTS

| | | |
|---|---|---|
| JP | 2017-132587 A | 8/2017 |
| JP | 2018-002382 A | 1/2018 |

*Primary Examiner* — Prasad V Gokhale
(74) *Attorney, Agent, or Firm* — XSENSUS LLP

(57) ABSTRACT

A medium feeder includes a medium container, a conveyor, a side fan, and circuitry. The medium container stores multiple sheets. The conveyor conveys, in a conveyance direction, an uppermost medium of the multiple media in the medium container. The side fan is disposed at both sides of the medium container in a width direction orthogonal to the conveyance direction to blow air to each side of the uppermost medium in an airflow direction. The circuitry controls the side fan to change the airflow direction according to a characteristic of the multiple media.

15 Claims, 10 Drawing Sheets

(56) References Cited

U.S. PATENT DOCUMENTS

| | | | | |
|---|---|---|---|---|
| 2018/0327202 | A1* | 11/2018 | Nakamura | B65H 3/128 |
| 2019/0152730 | A1 | 5/2019 | Hashimoto et al. | |
| 2019/0202647 | A1 | 7/2019 | Sugawara et al. | |
| 2019/0233226 | A1* | 8/2019 | Nakamura | B65H 3/48 |
| 2021/0292118 | A1 | 9/2021 | Fukasawa et al. | |
| 2023/0159289 | A1 | 5/2023 | Takamiya et al. | |
| 2023/0271798 | A1 | 8/2023 | Konno et al. | |
| 2024/0034578 | A1 | 2/2024 | Edo et al. | |
| 2024/0173968 | A1 | 5/2024 | Kasai | |
| 2025/0206556 | A1* | 6/2025 | Morita | B65H 3/128 |

* cited by examiner

FIG. 8

SHARE INFORMATION MANAGEMENT TABLE

Tb801

| | SHEET SIZE (SMALL ← → LARGE) | | | |
|---|---|---|---|---|
| BASIS WEIGHT (SMALL ↕ LARGE) | 0 | 0 | 0 | 0 |
| | 0 | 0 | 0 | 1 |
| | 0 | 1 | 1 | 1 |
| | 1 | 1 | 1 | 1 |

0: BLOW AIR IN OBLIQUE DIRECTION
1: BLOW AIR IN ORTHOGONAL DIRECTION

MEDIUM FEEDER AND IMAGE FORMING SYSTEM

CROSS-REFERENCE TO RELATED APPLICATIONS

This patent application is based on and claims priority pursuant to 35 U.S.C. § 119(a) to Japanese Patent Application No. 2024-062268, filed on Apr. 8, 2024, in the Japan Patent Office, the entire disclosure of which is hereby incorporated by reference herein.

BACKGROUND

Technical Field

Embodiments of the present disclosure relate to a medium feeder and an image forming system.

Related Art

A sheet feeder (medium feeder) is known that includes a sheet feeding mechanism that feeds a sheet-shaped medium (a sheet). In addition, an image forming system is also known in which a sheet feeder and an image forming apparatus for forming an image on a sheet fed from the sheet feeder are connected to each other.

Multiple methods are known as sheet pickup methods employed in a sheet feeder. For example, an air pickup method is known that sucks an uppermost sheet of multiple sheets stacked in a sheet container and sucks the floated sheet to attract the sheet onto a suction belt to convey the sheet.

Alternatively, a technology has been disclosed that stably separates an uppermost sheet of the stacked sheets and feed the uppermost sheet. In this technology, contact members contact lateral sides of the sheet bundle facing air outlets of air blowers, and the contact members in contact with the lateral sides of the sheet bundle are lifted together with the air blowers, and air is blown to the lateral sides of the sheet bundle to separate the sheet bundle and air is sent between the sheets.

SUMMARY

In an embodiment of the present disclosure, a medium feeder includes a medium container, a conveyor, a side fan, and circuitry. The medium container stores multiple media such as sheets. The conveyor conveys, in a conveyance direction, an uppermost medium of the multiple media in the medium container. The side fan is disposed at both sides of the medium container in a width direction orthogonal to the conveyance direction to blow air to each side of the uppermost medium in an airflow direction. The circuitry controls the side fan to change the airflow direction according to a characteristic of the multiple media.

In another embodiment of the present disclosure, an image forming system includes the medium feeder and an image forming apparatus to form an image on the uppermost medium fed from the medium feeder.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 8 is a block diagram illustrating a sheet information management table that is employed for the air sheet feeder of FIG. 4;

Figure 1:
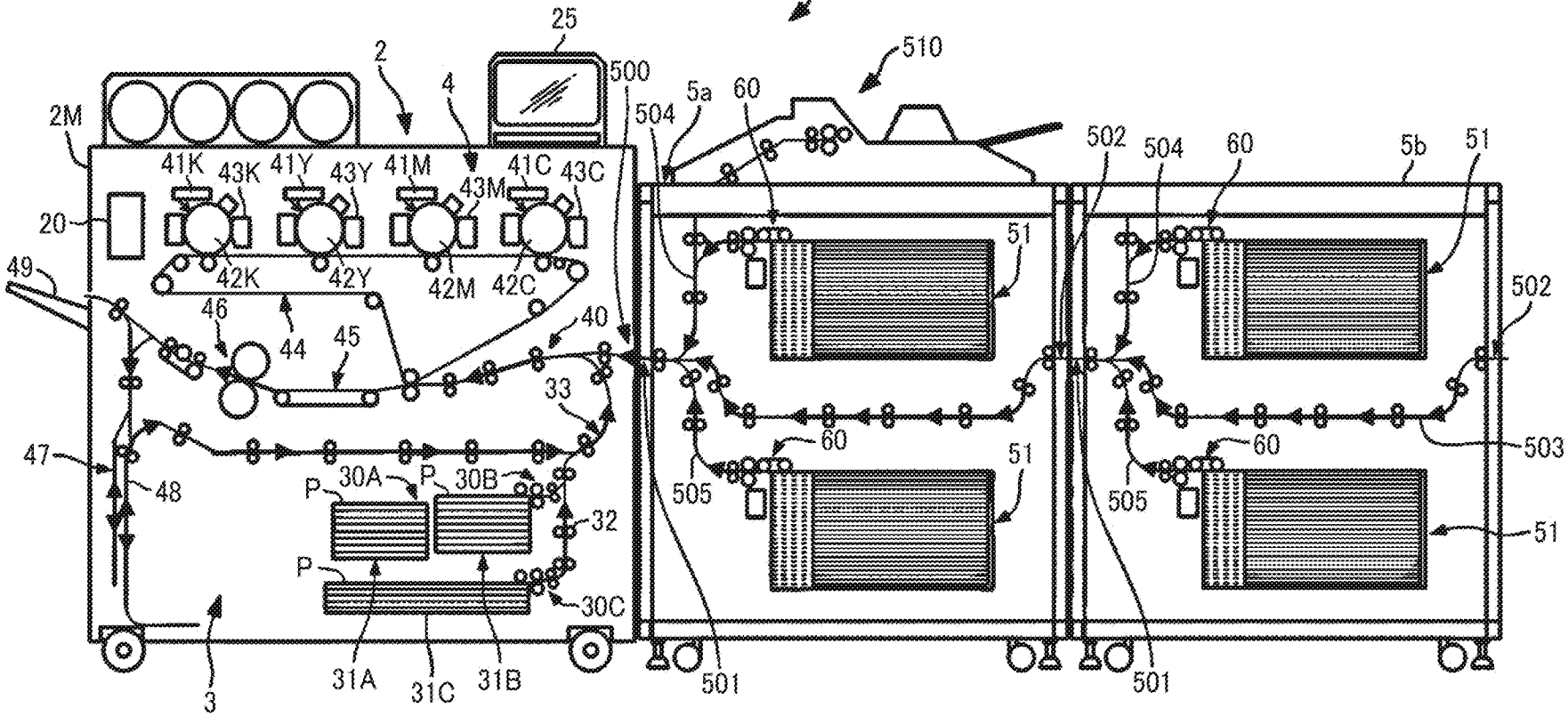
FIG. 1 is a diagram illustrating an overall configuration of an image forming system.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to the drawings. FIG. 1 is a diagram illustrating an overall configuration of a printing system 1. The printing system 1 as an image forming system includes an image forming apparatus 2 and connectable sheet (medium) feeders 5*a* and 5*b*.

The image forming apparatus 2 is a digital multifunction peripheral (MFP) that includes the functionality of the copying machine, the printer, and the facsimile machine. The image forming apparatus 2 includes an apparatus body 2M including a sheet feed device 3 and an image former 4. The apparatus body 2M includes a controller 20 that controls the image forming apparatus 2 and the connectable sheet feeders (medium feeders) 5*a* and 5*b*. The apparatus body 2M includes, for example, a touch screen on the upper surface of the apparatus body 2M. The touch screen displays various kinds of data, and at the same time, various kinds of input operations such as starting a print job to be sent to the controller 20 can be performed on the touch screen.

As illustrated in FIG. 1, the sheet feed device 3 includes multiple sheet trays 31A, 31B, and 31C. The sheet trays 31A, 31B, and 31C each can store cut sheets P (sheet media) in a stacked state. The sheet trays 31A, 31B, and 31C store, for example, sheets P of a sheet size selected in advance from multiple sheet sizes in a vertical or horizontal sheet feed direction.

The sheet feed device 3 includes sheet feed units 30A, 30B, and 30C that each sequentially pick up an uppermost one of the sheets P stored in one of the multiple sheet trays 31A, 31B, and 31C, and separate and feed the uppermost sheet P. The sheet feed device 3 further includes various rollers such as a roller pair 32. The various rollers constitute a sheet feeding path 33 on which the sheet P fed from the sheet feed units 30A, 30B, and 30C is conveyed to a predetermined image forming position of the image former 4.

The image former 4 includes exposure devices 41K, 41Y, 41M, and 41C and photoconductor drums 42K, 42Y, 42M, and 42C. The image former 4 further includes developing devices 43K, 43Y, 43M, and 43C that are filled with black color toner (K), yellow color toner (Y), magenta color toner (M), and cyan color toner (C), respectively. The image former 4 includes a primary transferor 44, a secondary transferor 45, and a fixing device 46.

The exposure devices 41K, 41Y, 41M, and 41C generate laser light for exposure of each color based on an image data input from, for example, an external personal computer. The exposure devices 41K, 41Y, 41M, and 41C expose the photoconductor drums 42K, 42Y, 42M, and 42C, respectively, of the respective colors to laser light, and form electrostatic latent images of the respective colors corresponding to the read image on the surface layers of the photoconductor drums 42Y, 42M, 42C, and 42K.

The developing devices 43K, 43Y, 43M, and 43C bring toner in thin layer close to the photoconductor drums 42K, 42Y, 42M, and 42C, respectively to supply the toner, and develop the electrostatic latent images into visible images with the toner.

The image former 4 primarily transfers toner images developed on the photoconductor drums 42K, 42Y, 42M, and 42C to the primary transferor 44, and secondarily transfers the toner images to the sheet P in the secondary transferor 45 adjacent to the primary transferor 44. The image former 4 heats and pressurizes the toner image secondarily transferred to the sheet P by the fixing device 46 to melt the toner image, and fixes and records a color image onto the sheet P.

The image former 4 includes a conveyance path 40 on which the sheet P is conveyed from the sheet feed device 3 via the sheet feeding path 33 to the secondary transferor 45. In the conveyance path 40, the conveyance timing and the conveyance speed of the sheet P are adjusted. The sheet P passes through the secondary transferor 45 and the fixing device 46 in synchronization with the belt speed at the primary transferor 44 and the secondary transferor 45. Subsequently, the sheet P is ejected onto an output tray 49.

A switchback conveyance path 47 and a reverse conveyance path 48 that each include, for example, multiple conveyance rollers and conveyance guides are disposed below the secondary transferor 45 and the fixing device 46.

In duplex printing in which images are formed on both sides of a sheet P, switchback conveyance operation is performed on the switchback conveyance path 47. In the switchback conveyance operation, after the sheet P, on which an image has been fixed on one side, enters from one end of the switchback conveyance path, the sheet P is conveyed in a reverse direction opposite to the direction in which the sheet P entered.

After the switchback conveyance operation is performed on the switchback conveyance path 47, the front and back sides of the sheet P are reversed in the reverse conveyance path 48, and the sheet P is again fed to the conveyance path 40.

In other words, the direction of conveyance of the sheet P on which an image has been fixed on one side is reversed on the switchback conveyance path 47. Subsequently, the front and back sides of the transfer sheet P are reversed in the reverse conveyance path 48 and the sheet P enters a secondary transfer nip again. After the secondary transfer operation of the image and the image fixing operation to the other side of the sheet P are completed, the sheet P is ejected onto the output tray 49.

The image forming apparatus 2 feeds the sheet P from the sheet feed device 3 in the apparatus body 2M via the sheet feeding path 33 and the conveyance path 40. In addition, the image forming apparatus 2 can also feed the sheet P to the connectable sheet feeders 5*a* and 5*b* via a connection path 500 disposed on a side surface of the apparatus body 2M.

Figure 2:
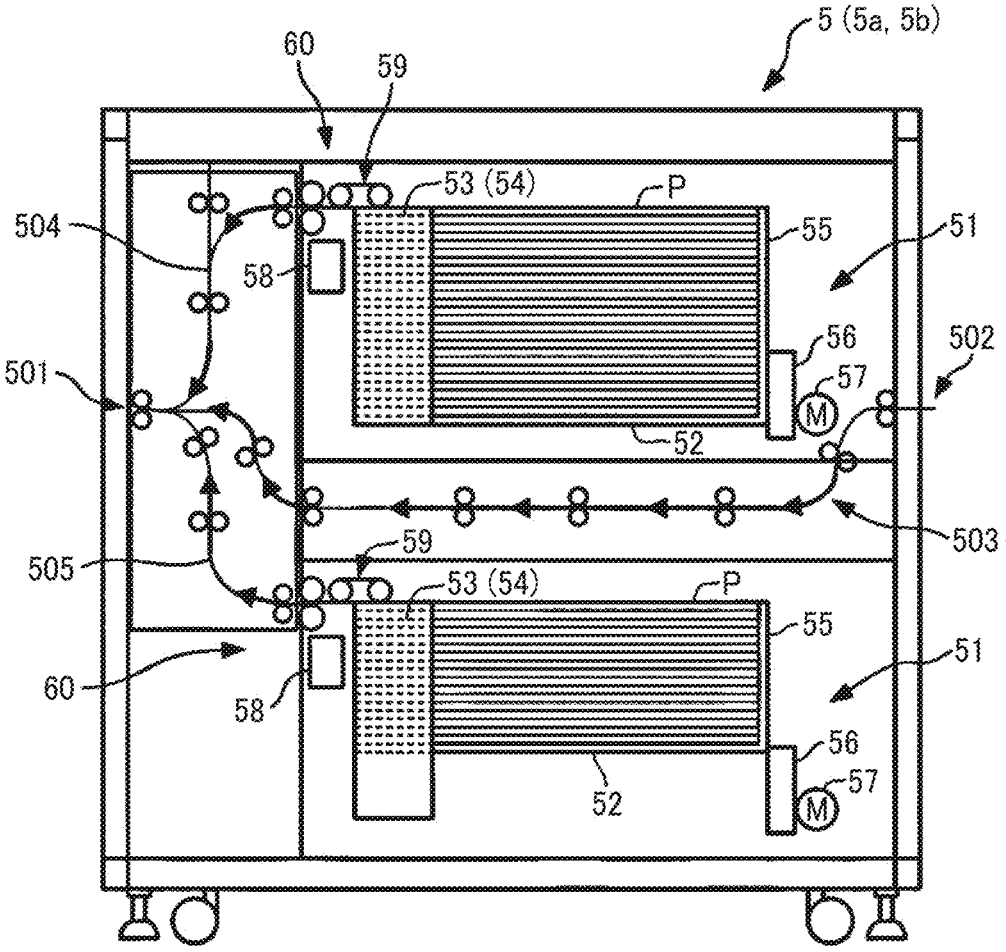
FIG. 2 is a diagram illustrating a sheet feeder connectable with the image forming system of FIG. 1.

In the printing system 1, each of the connectable sheet feeders 5*a* and 5*b* is a connectable sheet feeder 5 illustrated in FIG. 2. As illustrated in FIG. 2, the connectable sheet feeder 5 includes two sheet trays 51, a connection conveyance path 503 to connect connection paths 501 and 502, and sheet conveyance paths 504 and 505 to connect the connection path 501 and the sheet trays 51.

The connectable sheet feeder 5 is connectable to the image forming apparatus 2 such that the connection path 501 is connected to the connection path 500 (see FIG. 1) of the image forming apparatus 2. The connectable sheet feeder 5 is connectable to another connectable sheet feeder 5 such that the connection path 502 is connected to the connection path 501 of the other connectable sheet feeder 5.

In the following description, the sheet medium that is supplied from the connectable sheet feeders 5*a* and 5*b* are referred to as a sheet P. The sheet P in embodiments of the present disclosure is assumed to have various sizes and various basis weights. Currently, examples of application of the sheet P includes a gift card that can be easily purchased at stores. A gift card is a kind of card that is employed for purchasing in an electronic commerce (EC). When, for example, a card number, a personal identification number (PIN), and a code that are printed on the card are input on an EC site, input data is reflected as points of a recipient, which can be used for purchase in the EC site.

The connectable sheet feeders 5*a* and 5*b* of the present embodiment can handle various types of sheet P. However, in examples described below, the connectable sheet feeders 5*a* and 5*b* are described as a mechanism that feeds a sheet P having a large basis weight.

The printing system 1 illustrated in FIG. 1 includes the connectable sheet feeders 5*a* and 5*b* as external sheet feeders that feed sheets P to the image forming apparatus 2. The connectable sheet feeder 5*a* conveys the sheets P stacked on the sheet tray 51 via either the sheet conveyance paths 504 and 505, and feeds the sheet P to the conveyance path 40 via the connection path 500 of the image forming apparatus 2.

The connectable sheet feeder 5*b* conveys the sheet P stacked on the sheet tray 51 through either the sheet conveyance path 504 or 505 inside the connectable sheet feeder 5*b*. Subsequently, the connectable sheet feeder 5*b* feeds the sheet P to the conveyance path 40 via the connection conveyance path 503 of the connectable sheet feeder 5*a* and the connection path 500 of the image forming apparatus 2.

In the printing system 1, the image forming apparatus 2 and the connectable sheet feeders 5*a* and 5*b* are electrically connected to each other when they are connected to each other, and the sheet feeding operation of the sheet P is performed under the control of the controller 20. The controller 20 may be disposed in either the connectable sheet feeders 5*a* or 5*b* or may be disposed in both of the connectable sheet feeders 5*a* or 5*b*. The controller 20 may be disposed at any position as desired as long as the controller 20 can execute processing functions at the position.

Returning to FIG. 2, a description is given of the structure of the connectable sheet feeder 5. In the connectable sheet feeder 5, the multiple sheet trays 51 each includes a tray bottom plate 52, side fences 53 and 54, an end fence 55, a lifter 56, and a lifting motor 57.

In the sheet tray 51, multiple sheets P are stacked on the tray bottom plate 52. The tray bottom plate 52 is movable up and down by the lifter 56 driven by the lifting motor 57 when the sheets P are stacked as a sheet bundle. The tray bottom plate 52, the lifter 56, and the lifting motor 57 constitute a lifting device in embodiments of the present disclosure.

In the sheet tray 51, the side fences 53 and 54 restrict the sheets P stacked on the tray bottom plate 52 from moving in a width direction of the sheet P. The end fence 55 is disposed at the rear end of the sheets P in the sheet conveyance direction stacked on the tray bottom plate 52, and restricts the sheets P from moving in a direction opposite the sheet conveyance direction. The lifter 56 is disposed between the tray bottom plate 52 and the lifting motor 57 to couple with the tray bottom plate 52 and the lifting motor 57, and can lift and lower the tray bottom plate 52. In other words, the lifter 56 can lift and lower the sheets P on the tray bottom plate 52 by the rotational driving of the lifting motor 57.

The connectable sheet feeder 5 includes air sheet feeders 60 as air-pickup type sheet feeders. The air sheet feeder 60 blows air into a bundle of sheets P accommodated in the sheet tray 51 to float and separate the sheets P, and attracts the sheets P one by one by air to feed the sheet P to the sheet conveyance paths 504 and 505.

Air Sheet Feeder 60

Figure 3:
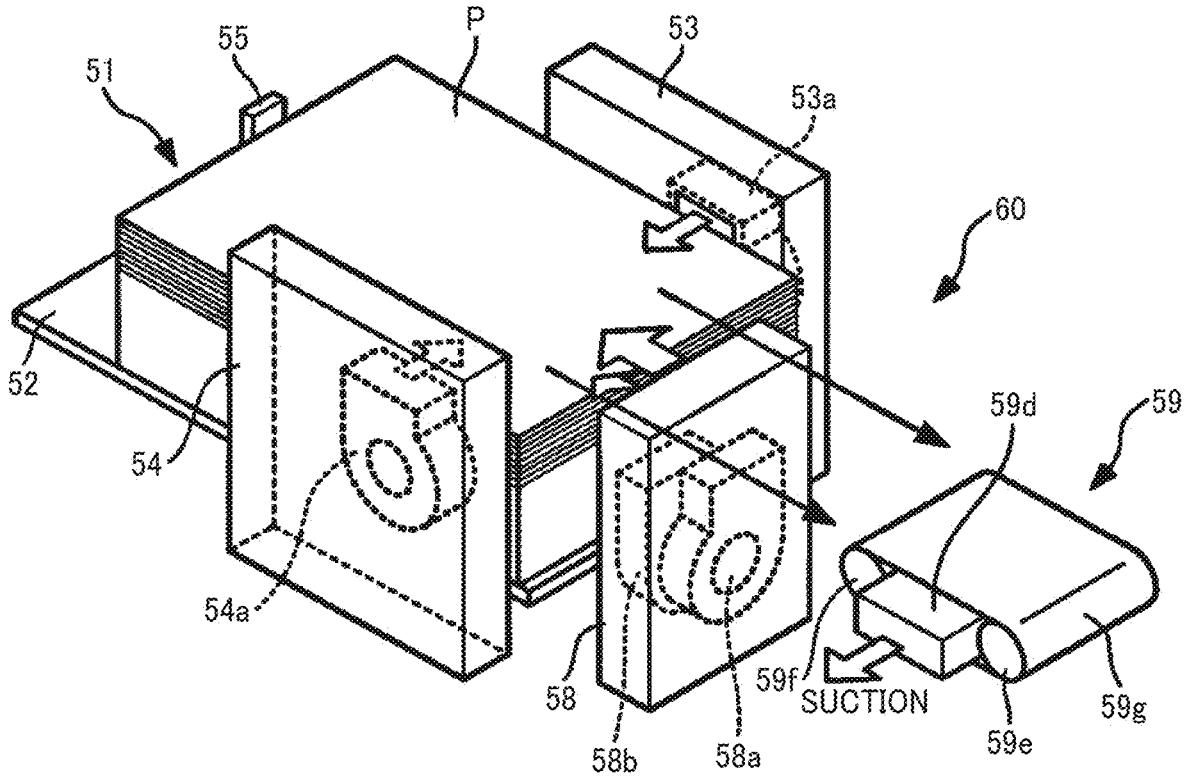
FIG. 3 is a perspective view of an air sheet feeder provided for the sheet feeder of FIG. 2.
Figure 4:
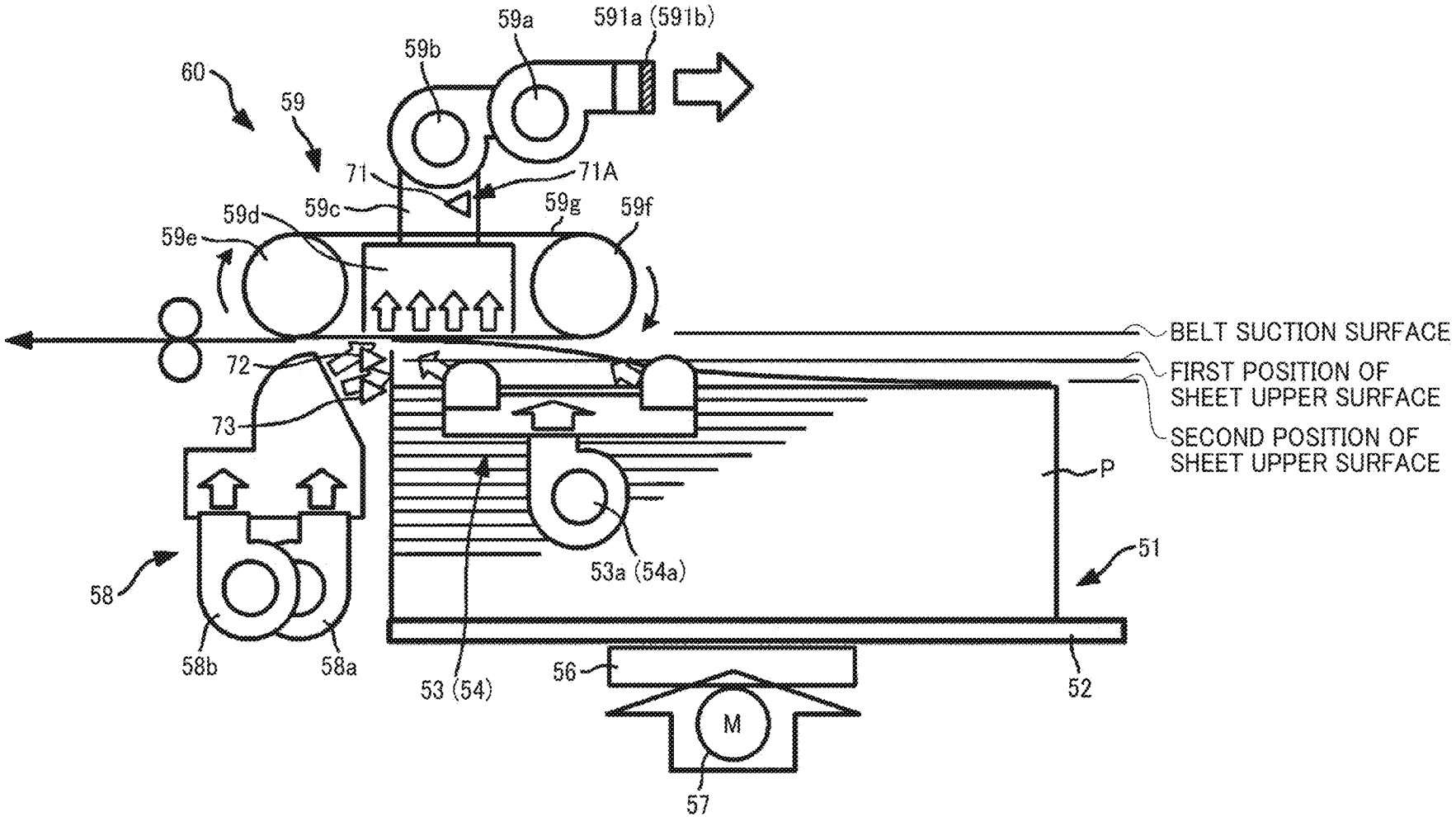
FIG. 4 is a side view of the air sheet feeder of FIG. 3.

Next, a description is given of the air sheet feeder 60 provided for the connectable sheet feeders 5*a* and 5*b* according to an embodiment of the present disclosure in more detail. As illustrated in FIGS. 2, 3, and 4, the air sheet feeder 60 includes the tray bottom plate 52, the side fences 53 and 54, and the end fence 55 that constitute the sheet tray 51, an air feed unit 58, and a belt feeding unit 59.

The air feed unit 58 is disposed downstream from the tray bottom plate 52 in the sheet conveyance direction, and includes a float fan 58*a* as a first front fan and a separation fan 58*b* as a second front fan to blow air to the sheets P from a front end side of the sheets P in the sheet width direction orthogonal to the sheet conveyance direction. The float fan 58*a* and the separation fan 58*b* blow air to the bundle of the sheets P from the front end side of the sheets P in the sheet width direction. By so doing, the float fan 58*a* and the separation fan 58*b* float and separate the sheets P stacked within a predetermined height area below the uppermost sheet P. The air feed unit 58 that includes the float fan 58*a* and the separation fan 58*b* serves as an air blower in embodiments of the present disclosure.

The side fences 53 of the sheet tray 51 includes a side fan 53*a* to blow air from the lateral side of the sheets P to the sheets P. Similarly, the side fence 54 includes a side fan 54*a* to blow air from the opposite lateral side of the sheets P to the sheets P. The side fans 53*a* and 54*a* blow air to the bundle of the sheets P from both lateral sides of the sheets P. By so doing, the side fans 53*a* and 54*a* facilitate floating and separation of the sheets P. The side fans 53*a* and 54*a* serve as air blowers in embodiments of the present disclosure.

As illustrated in FIGS. 3 and 4, the belt feeding unit 59 includes air suction fans 59*a* and 59*b*, a suction duct 59*c*, a suction chamber 59*d*, feeding roller pairs 59*e* and 59*f*, and a suction belt 59*g*.

The air suction fans 59*a* and 59*b* suck air in the suction chamber 59*d* via the suction duct 59*c* having an opening facing the upper surface of the uppermost sheet P of the bundle of sheets P stacked on the tray bottom plate 52 that makes up a sheet container. The air suction fans 59*a* and 59*b* include air filters 591*a* and 591*b*, respectively, for removing paper dust, calcium carbonate, dust and dirt such that they are not discharged to the outside the sheet feeder 5.

The suction belt 59*g* is an endless belt formed of, for example, rubber. The suction belt 59*g* is stretched between the pair of feeding roller pairs 59*e* and 59*f* to face an opening of the suction chamber 59*d*. The air suction fans 59*a* and 59*b* suck air to attract the sheet P onto the suction belt 59*g*. The pair of feeding roller pairs 59*e* and 59*f* are rotationally driven by a belt drive motor 59*h* described below, and convey the suction belt 59*g* with the sheet P attracted onto the suction belt 59*g* downstream in the sheet conveyance direction.

With the above-described configuration, in the belt feeding unit 59, the air feed unit 58 blows air to float and separate the sheets P, and the suction belt 59*g* sucks air via the suction duct 59*c* to attract the sheets P one by one from the uppermost sheet P.

Subsequently, in the belt feeding unit 59, the feeding roller pairs 59*e* and 59*f* are rotationally driven to rotate the suction belt 59*g*, and the sheet P attracted onto the circumferential surface of the suction belt 59*g* is fed and conveyed downstream in the sheet conveyance direction.

As described above, the air suction fans 59*a* and 59*b* that suck air through the suction duct 59*c* and the belt feeding unit 59 including the suction belt 59*g* collectively serve as a sheet suction conveyor in embodiments of the present disclosure.

In the air sheet feeder 60, the side fans 53*a* and 54*a*, the float fan 58*a*, the separation fan 58*b*, and the air suction fans 59*a* and 59*b* are selectively driven rotationally at respective activation timings in accordance with a timing at which the sheet P is fed, to control the sheet feeding operation of the sheets P. This control is performed by an air feeding controller 21 included in the controller 20. A description is given below of the configuration of the air feed controller 21 that serves as an airflow direction controller in embodiments of the present disclosure.

In the air sheet feeder 60, when the float fan 58*a* and the separation fan 58*b* start to rotate, air generated by the rotation of the float fan 58*a* and the separation fan 58*b* is blown to the leading end of the sheets P as separating air for separating the sheets P and floating air for floating the entire stacked sheets P through different duct paths.

In the air sheet feeder 60, when the side fans 53*a* and 54*a* disposed in the side fences 53 and 54, respectively, start to rotate, side air is blown to the lateral sides of the sheets P, and the side air floats the entire stacked sheets P similar to the floating air blown by the float fan 58*a*.

In the air sheet feeder 60, when the air suction fans 59*a* and 59*b* start to rotate, the suction air through the suction duct 59*c* brings the suction chamber 59*d* in the belt feeding unit 59 into a negative pressure state. By so doing, the air sheet feeder 60 attracts one uppermost sheet P of the bundle of the sheets P. When the uppermost sheet P is attracted to the suction belt 59*g*, the suction belt 59*g* is rotationally driven, and the sheet P is conveyed to the apparatus body 2M of the image forming apparatus 2.

In the above-described sheet feeding operation, the controller 20 determines sheet feeding parameters according to the sheet type, the sheet thickness, and the sheet size to automatically control the air volume, the switching between discharge and blocking of air from the side fans 53*a* and 54*a*, the float fan 58*a*, the separation fan 58*b*, and the air suction fans 59*a* and 59*b*.

Side Fans 53*a* and 54*a*

Next, a description is given of the side fans 53*a* and 54*a*. As described above, the side fans 53*a* and 54*a* blow air to the lateral sides of the stacked sheets P, and are disposed at positions facing each other with the sheet P interposed therebetween in the direction orthogonal to the sheet conveyance direction.

Figure 5A:
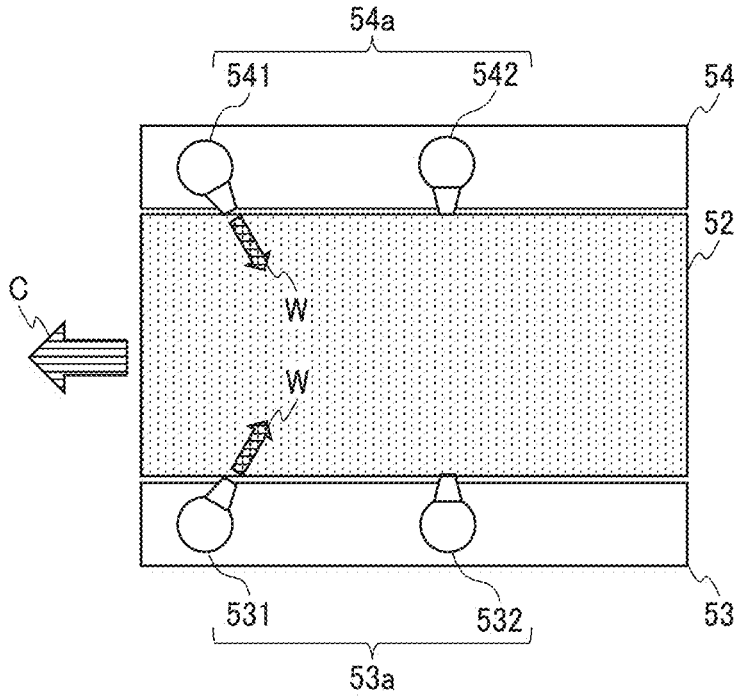
FIGS. 5A and 5B are plan views of the air sheet feeder of FIG. 4.
Figure 5B:
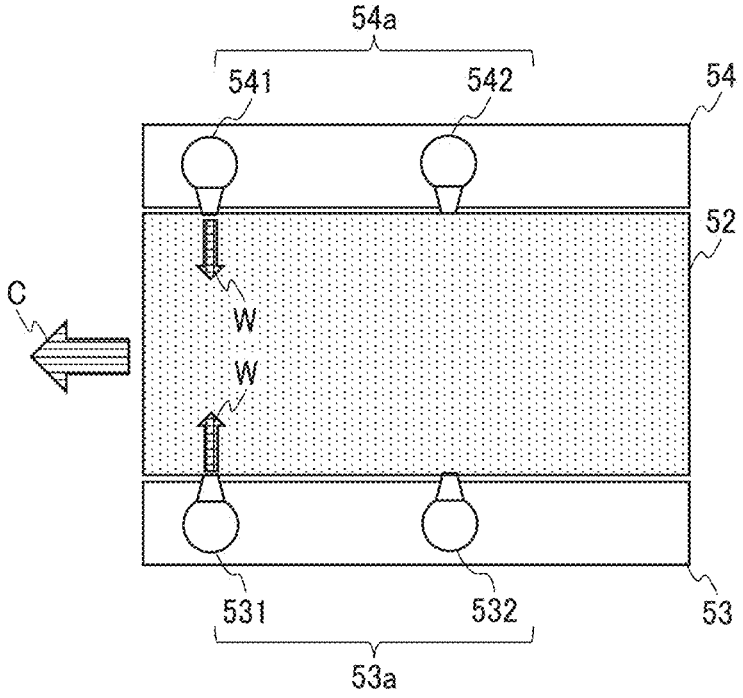

FIGS. 5A and 5B are plan views of the sheet container in which the side fences 53 and 54 are arranged, as viewed from above. As illustrated in FIGS. 5A and 5B, the side fans 53*a* and 54*a* are disposed in the side fences 53 and 54, respectively. The side fans 53*a* and 54*a* have multiple air outlets. For example, the side fan 53*a* has a left front air outlet 531 and a left center air outlet 532. The side fan 54*a* has a right front air outlet 541 and a right center air outlet 542.

The side fans 53*a* and 54*a* each have two air outlets arranged in a direction C in which the sheets P are fed, i.e., the sheet conveyance direction. The left front air outlet 531 and the right front air outlet 541 are each disposed in the vicinity of the downstream end of the sheet P in the sheet conveyance direction. The left center air outlet 532 and the right center air outlet 542 are each disposed at a position corresponding to, for example, substantially the middle of the sheet length of the sheet P in the conveyance direction. The relative positions of the left center air outlet 532 and the right center air outlet 542 differ depending on the length of the sheet P.

The left front air outlet 531 and the right front air outlet 541 are each attached to a rotary shaft 5411 whose axial direction is the direction in which the sheets P are stacked such that the angle in which air is blown with respect to the lateral sides of the stacked sheets P can be changed. The air feed controller 21 controls angles W in which air is blown, i.e., directions in which air is blown by the left front air outlet 531 and the right front air outlet 541. The air feed controller 21 can switch the angles W in which air is blown from the left front air outlet 531 and the right front air outlet 541 to either of two airflow directions, for example, an airflow direction inclined with respect to the sheet conveyance direction as illustrated in FIG. 5A, and an airflow direction orthogonal to the lateral sides of the sheets P as illustrated in FIG. 5B.

For example, when the basis weight of the sheet P is less than a predetermined threshold, in other words, when the basis weight of the sheet P is similar to a basis weight of a sheet P which can be floated by a known technology, as illustrated in FIG. 5A, the air is blown toward upstream of the sheets P in the sheet conveyance direction. Setting the airflow directions as described above, the air that is blown to the sheets P can flow to an area downstream in the sheet conveyance direction. Thus, for example, turbulence of airflow can be reduced while maintaining a condition in which the sheets P are unlikely to be floated. Accordingly, the uppermost sheet P can be separated.

When the basis weight of the sheet P is equal to or larger than the predetermined threshold, in other words, when the basis weight of the sheet P is heavier than the basis weight of the known sheet P and is similar to the basis weight of a so-called super thick paper, air is blown in the direction orthogonal to the lateral sides of the sheets P as illustrated in FIG. 5B. As described above, even the sheet P having a large basis weight can be sufficiently floated. As a result, supply failure of the sheets P can be prevented. At the same time, airflows that are generated by the side air can be stabilized. Accordingly, the sheets P having a small basis weight can be reliably fed.

Hardware Configuration

Figure 6:
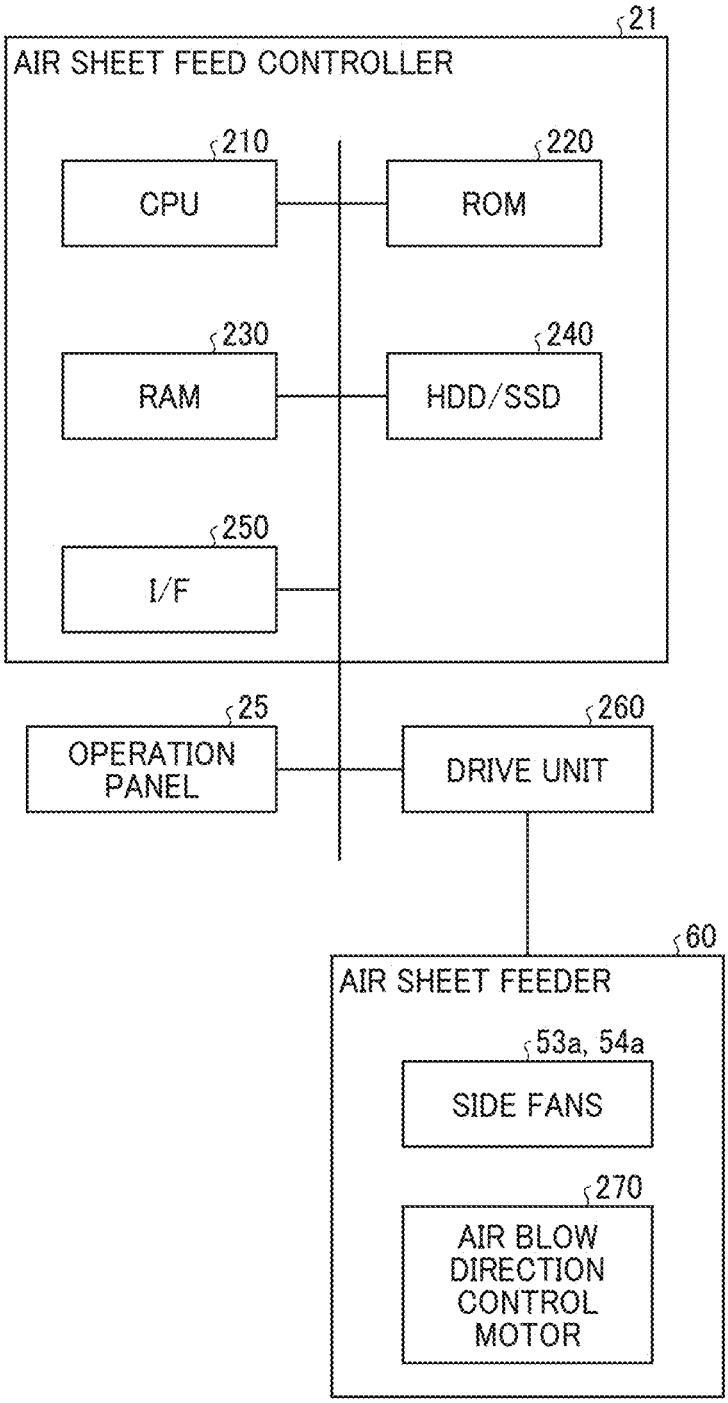
FIG. 6 is a block diagram of a hardware configuration of an air feed controller that controls the air sheet feeder of FIG. 4.

FIG. 6 is a block diagram of a hardware configuration of the air feed controller 21 that controls the air sheet feeder 60. As illustrated in FIG. 6, the air feed controller 21 includes a central processing unit (CPU) 210, a read only memory (ROM) 220, a random access memory (RAM) 230, a hard disk drive (HDD)/solid state drive (SSD) 240, and an interface (I/F) 250. The above-described components are connected to each other via a system bus and can communicate with each other.

The CPU 210 executes control processing including various kinds of arithmetic processing.

The ROM 220 is a nonvolatile memory that stores a program employed for driving the CPU 210, such as an initial program loader (IPL).

The RAM 230 is a volatile memory employed as a work area of the CPU 210.

The HDD/SSD 240 is a nonvolatile memory that can store various data and programs employed for control by the air feed controller 21.

The I/F 250 is an interface through which communication between the air feed controller 21 and a device or an apparatus other than the air feed controller 21 is performed. Note that the I/F 250 can also serve as an interface through which communication between the air feed controller 21 and a device or an apparatus other than the air feed controller 21 is performed via a network. The devices other than the air feed controller 21 are, for example, an operation panel 25, the driver 260. The devices other than the air feed controller 21 are, for example, an external personal computer (PC), an external server.

The operation panel 25 can receive an operation of the operator to operate the printing system 1.

The operation panel 25 may include, for example, a touch panel, a button, and a keyboard. The operation panel 25 may also serve as a notification unit that notifies the airflow direction set for the side fans 53*a* and 54*a*. In this case, the operation panel 25 displays data to notify whether the airflow direction is orthogonal to the lateral sides of the sheets P or inclined toward the upstream of the sheets P in the sheet conveyance direction in an easily recognizable manner.

The driver 260 includes an electric circuit. The driver 260 is connected to the air sheet feeder 60 to control driving of the side fans 53*a* and 54*a* of the air sheet feeder 60 and driving of the air-blow direction control motor 270 as an air outlet rotator. The air-blow direction control motor 270 rotates to switch the air blow direction of the side fans 53*a* and 54*a*.

Functional Configuration

Figure 7:
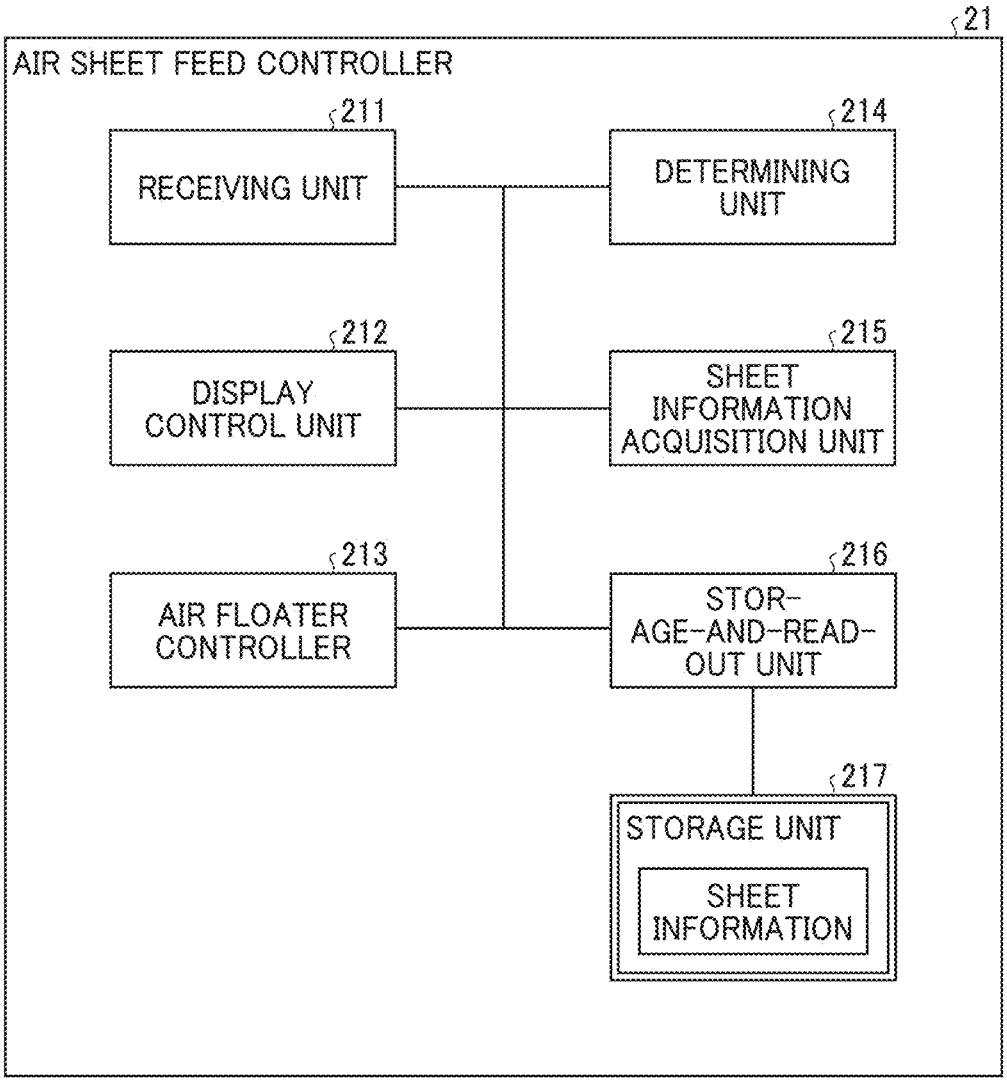
FIG. 7 is a functional block diagram of the air sheet feeder of FIG. 4.

FIG. 7 is a functional block diagram of a configuration of the air feed controller of the printing system 1. As illustrated in FIG. 7, the air sheet feeder 60 includes a receiving unit 211, a display controller 212, an air floating unit controller 213, a determining unit 214, a sheet information acquisition unit 215, and a storage-and-readout unit 216.

These elements or units are functions implemented by or caused to function by operating some of the elements illustrated in FIG. 6 under the control of the instructions from the CPU 210 in accordance with the controller program developed on the RAM 230. The air sheet feeder 60 includes a storage unit constructed by, for example, the ROM 220, the HDD/SSD 240, illustrated in FIG. 6.

The receiving unit 211 is typically implemented by processing of the CPU 210 and receives various selections or inputs on the operation panel 25 from the operator.

The display controller 212 is typically implemented by processing of the CPU 210, and causes a display unit such as the operation panel 25 to display various screens.

The air floating unit controller 213 is typically implemented by processing of the CPU 210, and controls driving of the air supply fans, i.e., the side fans 53*a* and 54*a* of the air sheet feeder 60 and driving of the air-blow direction control motor 270.

The determining unit 214 is implemented by processing of the CPU 210 and performs various determinations.

The sheet information acquisition unit 215 is typically implemented by processing of the CPU 210, and acquires sheet information from the data received by the receiving unit 211.

The storage-and-readout unit 216 is typically implemented by processing of the CPU 210, and stores various kinds of data in a storage unit and reads various kinds of data from the storage unit.

Each of the functions described above can also be implemented by one or multiple processing circuits. The processing circuit in embodiments of the present disclosure includes devices such as an application specific integrated circuit (ASIC), a digital signal processor (DSP), and a typical circuit module designed to execute the functions described above. Further, some of the functions of the air feed controller 21 can be implemented by an external device such as an external PC or an external server that is communicably connected to the air feed controller 21. Further, some of the functions of the air feed controller 21 can be implemented by distributed processing between the air feed controller 21 and the external devices.

Sheet Data Management Table

FIG. 8 is a block diagram illustrating a sheet information management table that is employed for the air sheet feeder 60. The storage unit 217 illustrated in FIG. 7 includes a sheet information management database (DB) including a sheet information management table Tb801 illustrated in FIG. 8. The sheet information management table Tb801 is a data group in which, for example, an instruction to switch the direction of air blown onto the sheet P is associated with characteristic data such as the basis weight of the sheet P and the size of the sheet P.

For example, in the sheet information management table Tb801 illustrated in FIG. 8, the direction of air blown to the sheet P is set in advance based on actual measurement data to change from a flag 0, which means air is blown in an oblique direction with respect to the sheet P, to a flag 1, which means air is blown in an orthogonal direction orthogonal to the sheet P, as the basis weight and the size of the sheet P increase. The sheet information management table illustrated in FIG. 8 is an example, and embodiments of the present disclosure is not limited to this. The basis weight and size of the sheet P may be further subdivided. In addition, the direction of air blown to the sheet P may be subdivided to and switchable between different inclination angles in the oblique direction, not only to switch between and select from two kinds of the oblique direction and the orthogonal direction.

For example, when the size of the sheet P to be printed is limited to one type or a narrow range, the basis weight of the sheet P and the direction of air blown are associated with each other in the sheet information management table Tb801, and the direction of air blown to the sheet P may be determined based on only the data of the basis weight of the sheet P.

Processing or Operation of Embodiment

Figure 9:
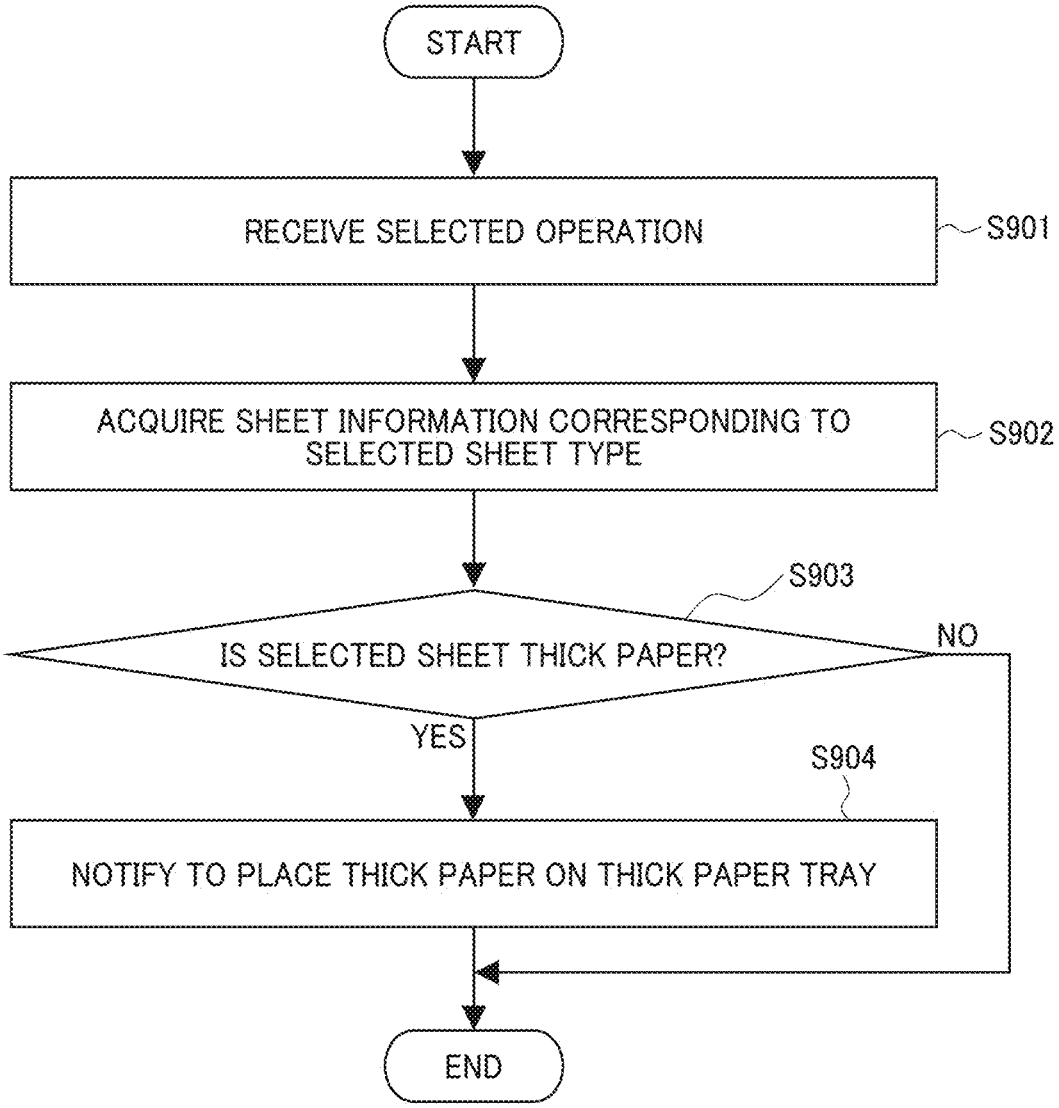
FIG. 9 is a flowchart of a control procedure of the air sheet feeder of FIG. 4.

FIG. 9 is a flowchart of a control procedure of an air pickup mechanism in which an operation is started until a notification to place a thick paper on the thick paper tray is informed. When the printing system 1 is operated to form an image (printing), first, the operator selects the type of the sheet P to be employed for image formation. The selection operation of the sheet P may be performed by any method such as a method in which the operator inputs the type of the sheet P via an input interface on the operation panel 25.

When the selection operation of the sheet P is performed on the operation panel 25, the receiving unit 211 receives the selection operation (step S901).

When the receiving unit 211 receives the selection operation of the sheet P, the sheet information acquisition unit 215 acquires the sheet information corresponding to the selected sheet P from the sheet information stored in the storage unit 217 via the storage-and-readout unit 216 (step S902).

Next, the determining unit 214 determines whether the sheet P is thick paper based on the sheet information acquired by the sheet information acquisition unit 215 (step S903). If the determination result in step S903 is YES (the sheet P is thick paper), the display controller 212 notifies the operator to place and load thick paper to be employed for image formation on the thick paper tray (step S904).

The notification may be performed by any method that can be recognized by the operator. For example, a message that prompts the operator to place the sheet P on the sheet tray 51 for thick paper may be displayed on the operation display unit, or a warning lamp may be disposed for the sheet tray 51 for thick paper and the warning lamp is lighted to send the notification. If the determination result in step S903 is NO (the sheet P is not thick paper), the notification as described above is not necessary, and the processing is completed.

Configuration of Straight Conveyance Path

Figure 10:
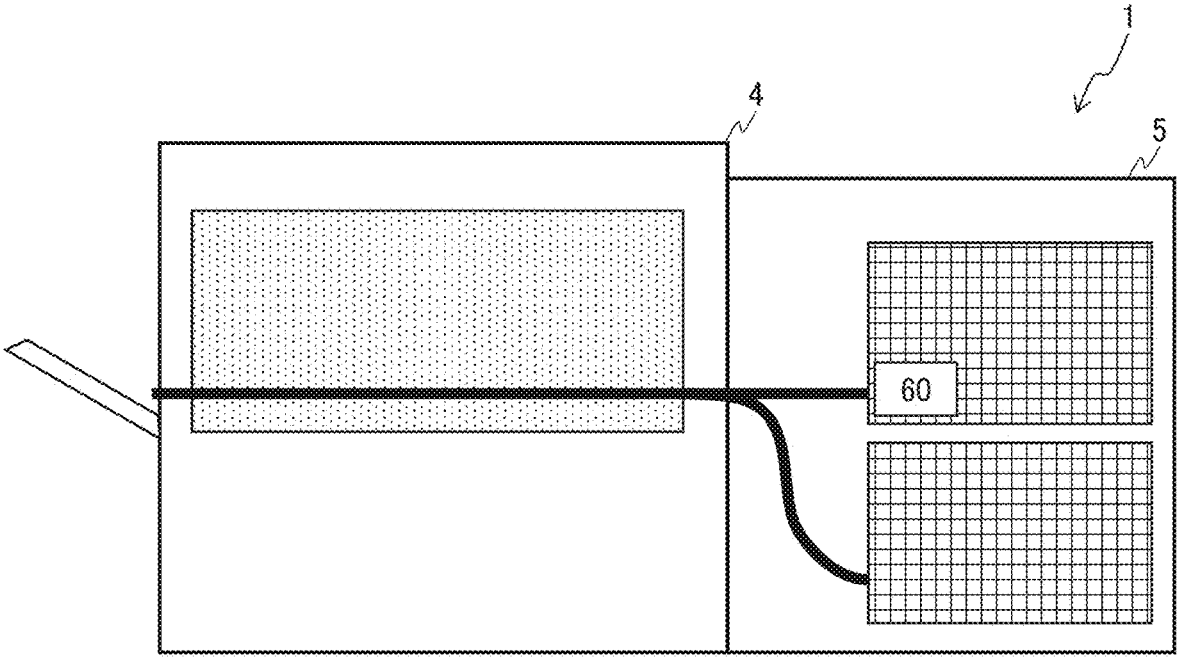
FIG. 10 is a diagram illustrating an overall configuration of an image forming system, according to another embodiment of the present disclosure.

FIG. 10 is a diagram illustrating an overall configuration of the printing system 1 according to another embodiment of the present disclosure, in which relative positions of the air sheet feeder 60 and the image former 4 including the secondary transferor 45. As illustrated in FIG. 10, the air sheet feeder 60 is disposed on the conveyance path at a height position corresponding to a substantially similar height position at which the secondary transferor 45 of the image former 4, in which an image is formed on the sheet P, is disposed.

Such a configuration allows the degree of curvature of the conveyance path of the sheet P, when the sheet P is ultra-thick paper having high rigidity, to be minimized. Accordingly, the sheet P can be conveyed linearly on the conveyance path.

Embodiments of the present disclosure are not limited to specific embodiments described above, and numerous additional modifications and modifications are possible in light of the teachings within the technical scope of the appended claims. The above-described embodiments and modifications are some examples, and various modifications and modifications can be practiced from such examples by those skilled in the art. Such modifications and variations are included in the technical scope described in the appended claims.

Further, the control method described above may be achieved by, for example, a program. In other words, the control method may be executed by causing an arithmetic device, a storage device, an input device, an output device, and a controller to operate in cooperation with each other based on a program. The program may be written in, for example, a storage device or a storage medium and distributed with the storage device or the storage medium, or may be distributed through, for example, an electric communication line.

Aspects of the present disclosure are, for example, as follows.

First Aspect

A medium (sheet) feeder includes an air sheet feeder to float an uppermost sheet of multiple stacked sheets by air and feed the sheet downstream in a conveyance direction, a medium container to store multiple media, an air blower to blow air onto an uppermost medium, and an air feed controller to control an airflow direction of the air blower according to a characteristic of the medium.

Second Aspect

In the medium feeder according to the first aspect, the air blower includes an air outlet and an air-blow direction control motor to cause the air outlet to rotate about an axial direction of which the multiple media are stacked.

The air feed controller causes the air blower to rotate to set an airflow direction to a lateral side of the medium between either an orthogonal direction orthogonal to the lateral side of the medium, i.e., parallel to the width direction or an inclined direction inclined with respect to the lateral side in accordance with characteristics of the medium.

Third Aspect

In the medium feeder according to the second aspect, the air feed controller sets the airflow direction to the orthogonal direction when a basis weight of the medium is equal to or greater than a predetermined threshold value, and sets the airflow direction to the inclined direction when a basis weight of the medium is smaller than the predetermined threshold value.

Fourth Aspect

In the sheet feeder according to the third aspect, the air feed controller causes the air blower to rotate the air blower to face upstream in the conveyance direction when the airflow direction is the inclined direction.

Fifth Aspect

The medium feeder according to any one of the first to fourth aspects, further includes a notification unit, i.e., an operation panel, to notify the airflow direction to an operator.

The airflow direction controller controls the notification unit to notify the type of the airflow direction according to the characteristics of the medium.

Sixth Aspect

In the medium feeder according to the fifth aspect, the notification unit is an operation panel that also serves as an input interface for an operator to input characteristic information of the sheet.

Seventh Aspect

In the medium feeder according to the fifth or sixth aspect, the medium container includes the notification unit.

Eighth Aspect

An image forming system includes an image forming apparatus to form an image on a sheet, and the medium feeder according to any one of the first to seventh aspects. The medium feeder separates and feeds an uppermost one of multiple media stacked to convey the medium to the image forming apparatus.

Ninth Aspect

The image forming system according to the eighth aspect, further includes the multiple sheet containers. The air blower is disposed at a height position corresponding to a substantially same height position on the conveyance path connecting to the image forming apparatus.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A medium feeder comprising:

a medium container to store multiple media;

a conveyor to convey, in a conveyance direction, an uppermost medium of the multiple media in the medium container;

a side fan at both sides of the medium container in a width direction orthogonal to the conveyance direction to blow air to each side of the uppermost medium in an airflow direction;

a rotator to rotate the side fan; and circuitry configured to control the side fan to change the airflow direction according to a characteristic of the multiple media, wherein the circuitry is configured to:

control the side fan to direct the airflow direction to parallel to the width direction when a basis weight of the uppermost medium is equal to or greater than a predetermined threshold value; and control the side fan to direct the airflow direction to an inclined direction when the basis weight of the uppermost medium is smaller than the predetermined threshold value.

2. The medium feeder according to claim 1, wherein the circuitry is further configured to control the side fan to direct the airflow direction to an inclined direction directed toward an upstream side in the conveyance direction.

3. The medium feeder according to claim 1, further comprising a first air outlet to exhaust the air from the side fan and a second air outlet to exhaust the air from the side fan, wherein said first air outlet is disposed closer to a center of the multiple media in the conveyance direction than the second air outlet.

4. The medium feeder according to claim 1, further comprising a front fan disposed downstream of the medium container in the conveyance direction to blow air toward the uppermost medium in a direction opposite to the conveyance direction.

5. The medium feeder according to claim 4, wherein the front fan includes a first front fan and a second front fan, and the first front fan and the second front fan blow air toward different directions from each other.

6. The medium feeder according to claim 4, wherein the front fan includes a first front fan and a second front fan.

7. The medium feeder according to claim 1, further comprising an air suction fan to attract an upper surface of the uppermost medium.

8. An image forming system comprising:

the medium feeder according to claim 1; and an image forming apparatus to form an image on the uppermost medium fed from the medium feeder.

9. The image forming system according to claim 8, further comprising multiple containers including the medium container, wherein one of the multiple containers is disposed at a same height as the image forming apparatus, and said one of the multiple containers includes the side fan.

10. The image forming system according to claim 8, further comprising multiple containers including the medium container.

11. The image forming system according to claim 8, further comprising multiple containers including the medium container, wherein one of the multiple containers is disposed at a same height as the image forming apparatus.

12. The medium feeder according to claim 1, wherein the conveyor conveys, in the conveyance direction, the uppermost medium of the multiple media including sheets.

13. The medium feeder according to claim 1, further comprising a first air outlet to exhaust the air from the side fan and a second air outlet to exhaust the air from the side fan.

14. A medium feeder comprising:

a medium container to store multiple media;

a conveyor to convey, in a conveyance direction, an uppermost medium of the multiple media in the medium container;

a side fan at both sides of the medium container in a width direction orthogonal to the conveyance direction to blow air to each side of the uppermost medium in an airflow direction;

circuitry configured to control the side fan to change the airflow direction according to a characteristic of the multiple media; and a display to display the airflow direction, wherein the circuitry is configured to control the display to display the airflow direction according to the characteristics of the multiple media.

15. The medium feeder according to claim 14, wherein the display includes an operation panel to which the characteristic of the multiple media is input.

* * * * *